US005238124A

United States Patent [19]

Canè et al.

[11] Patent Number: 5,238,124

[45] Date of Patent: Aug. 24, 1993

[54] APPARATUS FOR SORTING HARD GELATINE CAPSULES

[75] Inventors: Aristide Canè, San Lazzaro di Savena; Angiolino Ribani, Ozzano Emilia, both of Italy

[73] Assignee: IMA Industria Macchine Automatiche S.p.A., Ozzano Emilia, Italy

[21] Appl. No.: 881,637

[22] Filed: May 12, 1992

[30] Foreign Application Priority Data

Jun. 12, 1991 [IT] Italy ..... GE91A000083

[51] Int. Cl.[5] ..... B07B 13/05

[52] U.S. Cl. ..... 209/660; 209/667; 209/672; 209/674; 209/920; 209/940; 198/384; 198/389

[58] Field of Search ..... 209/659, 660, 666, 667, 209/670, 671, 672, 674, 680, 682, 920, 940; 198/384, 389, 534

[56] References Cited

U.S. PATENT DOCUMENTS

| | | | |
|---|---|---|---|
| 3,455,445 | 7/1969 | Allen et al. | 209/679 X |
| 3,997,058 | 12/1976 | Greer et al. | 209/660 X |
| 4,172,526 | 10/1979 | Moser | 209/659 X |
| 4,379,509 | 4/1983 | Bohle | 209/6672 X |
| 4,391,374 | 7/1983 | Krynock | 209/682 X |
| 4,462,508 | 7/1984 | Grafius | 209/940 X |
| 4,579,652 | 4/1986 | Bielagus | 209/672 X |
| 4,640,407 | 2/1987 | Widener et al. | 198/389 |
| 4,682,683 | 7/1987 | Ackley, Sr. et al. | 198/384 X |

FOREIGN PATENT DOCUMENTS

| | | |
|---|---|---|
| 0022275 | 1/1981 | European Pat. Off. |
| 3418489 | 2/1985 | Fed. Rep. of Germany . |

*Primary Examiner*—Joseph E. Valenza
*Assistant Examiner*—Tuan Nguyen
*Attorney, Agent, or Firm*—Larson and Taylor

[57] ABSTRACT

The apparatus makes use of a pair of rotating combs (11-14), the discs of the second comb being interposed between the discs of the first comb and positioned at the top between fixed guide plates (17). The discs of the first comb intercept the streams of closed capsules, from which any covers not provided with shells have already been removed. The capsules are inserted by their shells between the discs of the first comb and remain suspended on said discs by their covers (C1). Only capsule shells and any crushed capsules fall through the discs of the first comb. The capsules conveyed by the first rotating comb arrive on the discs of the second comb, generally with their covers at the front. The second comb transfers the capsules to the longitudinal guide channels (107') of a short vibrating table (7'), which in the initial part of each channel is provided with a longitudinal aperture (19) which allows the capsule shell to pass through but holds the capsule covers, which in this way arrive in a vertical position at a discharge hole (20). Any capsules carrying two covers pass over said hole (20) and are discharged into the hopper for rejects.

10 Claims, 4 Drawing Sheets

1
101
103
201
C1
C2
C
2
3
4
8
H
D
5
6
7
9
10
11
12
13
14
15
17
18
19
20
21
107
107'
7'
110
121
210
A
F
III
IV

APPARATUS FOR SORTING HARD GELATINE CAPSULES

The invention relates to a technologically highly reliable apparatus for sorting hard gelatine capsules. During transport from the place of production to the place of use, and during the handling operations to which they are subjected before actual use, pre-closed hard gelatine capsules are subject to vibration and shocks, which may give rise to the separation of the two parts of which they are composed, and which may damage them. It is therefore necessary to sort out empty, pre-closed capsules before they are passed to the working cycle of a capping machine, which opens them, inserts the product into them, and closes them.

The apparatus in question has in particular been designed to operate on the stream of empty capsules upstream of the capping machine, in order to separate undeformed, correctly pre-closed capsules from those which are open or not correctly closed, or are crushed. The apparatus can however indiscriminately also operate on filled, closed capsules which are to be fed to packing machines, for example blister packing machines, so that it must be understood that it is also protected for this different use.

Sorting apparatuses of known type mainly operate by vibration and create conditions for conveying the capsules which may result in the opening of the latter even if they are correctly pre-closed or closed.

The invention provides a sorting apparatus which handles the capsules gently, which does not subject them to vibration under critical conveying conditions with the shell suspended, and which consequently has very great efficiency and great technological reliability.

The features of an apparatus of this kind and the advantages which it provides will emerge from the following description of a preferred form of construction thereof, which is illustrated solely by non-limitative example in the figures of the accompanying two sheets of drawings, in which.

Figure 1:
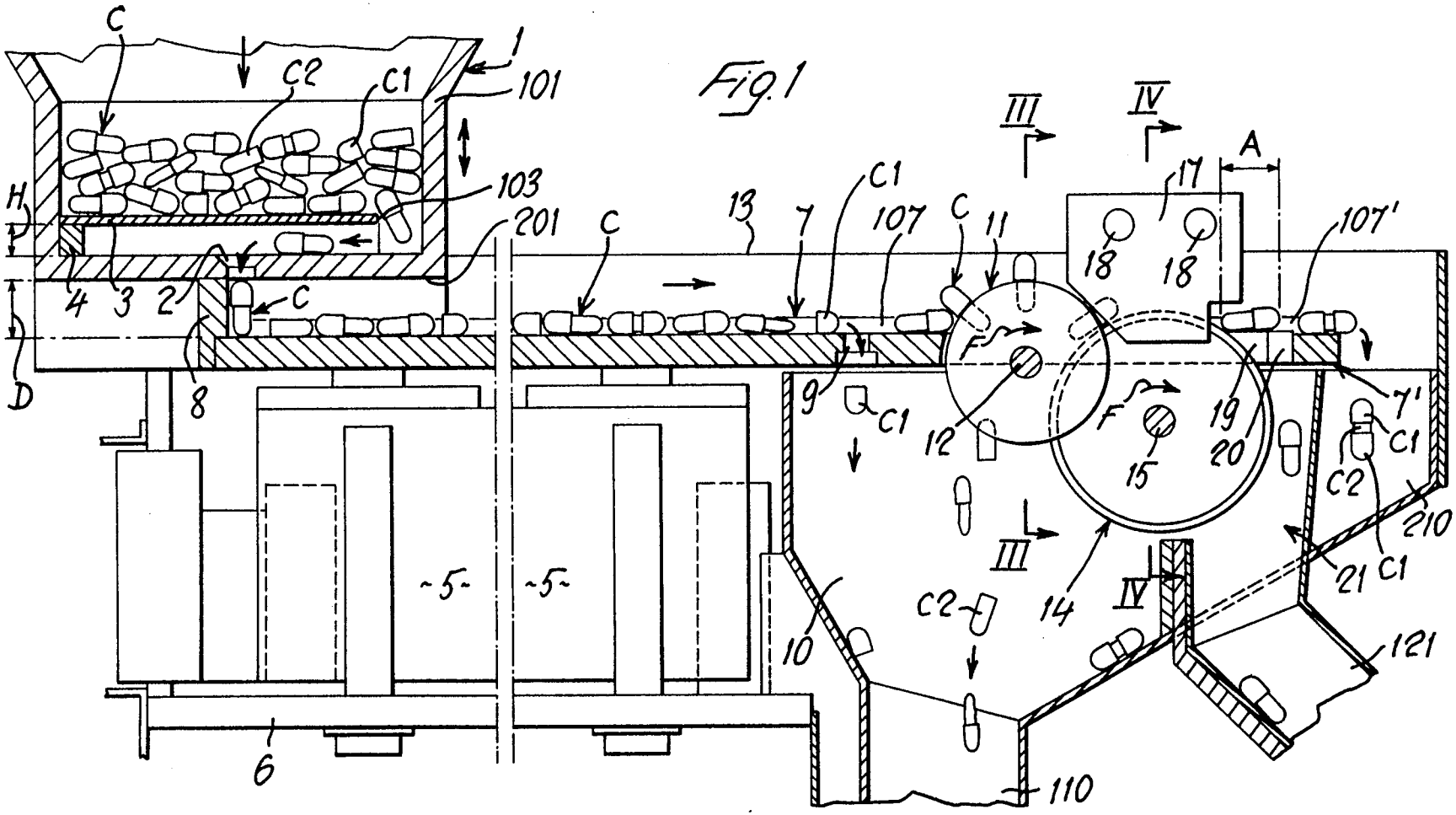
FIG. 1 is a side view of the apparatus, with parts in section.

In FIG. 1 it can be seen that the capsules to be sorted, which are all of the same size and shape, are placed at random in a feed hopper 1, which has a lower end portion 101 of parallelepipedic shape and is provided in a roughly central position on its bottom with a transverse row of holes 2 suitably spaced apart and having a diameter appropriately larger than that of the cover of the capsules, with a widening at the top. Above the row of holes 2 is disposed a double-bottomed wall 3 supported by supports 4 on two or three sides and having at least the side 103 at a distance from the neighbouring side wall of the part 101 of the hopper, so as to allow the passage of limited quantities of capsules C. The wall 3 is at a distance H from the bottom 201 of the hopper appropriately greater than the diameter of the capsules C, for example one and a half times that diameter.

The fixed structure 6 supports a vibrator 5 of any suitable type, on the appropriately ballasted movable unit of which is detachably mounted the previously mentioned hopper 1, together with a horizontal table 7 disposed beneath said hopper and provided with longitudinal V-profiled channels 107, which are parallel to one another and equidistant and which at one end are positioned in line with each of the holes 2 through which the capsules C pass out of the hopper, at which point said capsules are guided in their fall by a wall 8 fixed to the table 7 and preferably slightly inclined to assist the horizontal positioning and longitudinal alignment of said capsules in the respective guide channels 107.

Purely by way of indication it is pointed out that the distance D between the outer wall of the hopper bottom 201 and the point of contact between the capsule and the respective channel 107 is approximately equal to or slightly greater than the length of a correctly pre-closed or closed capsule.

Figure 2:
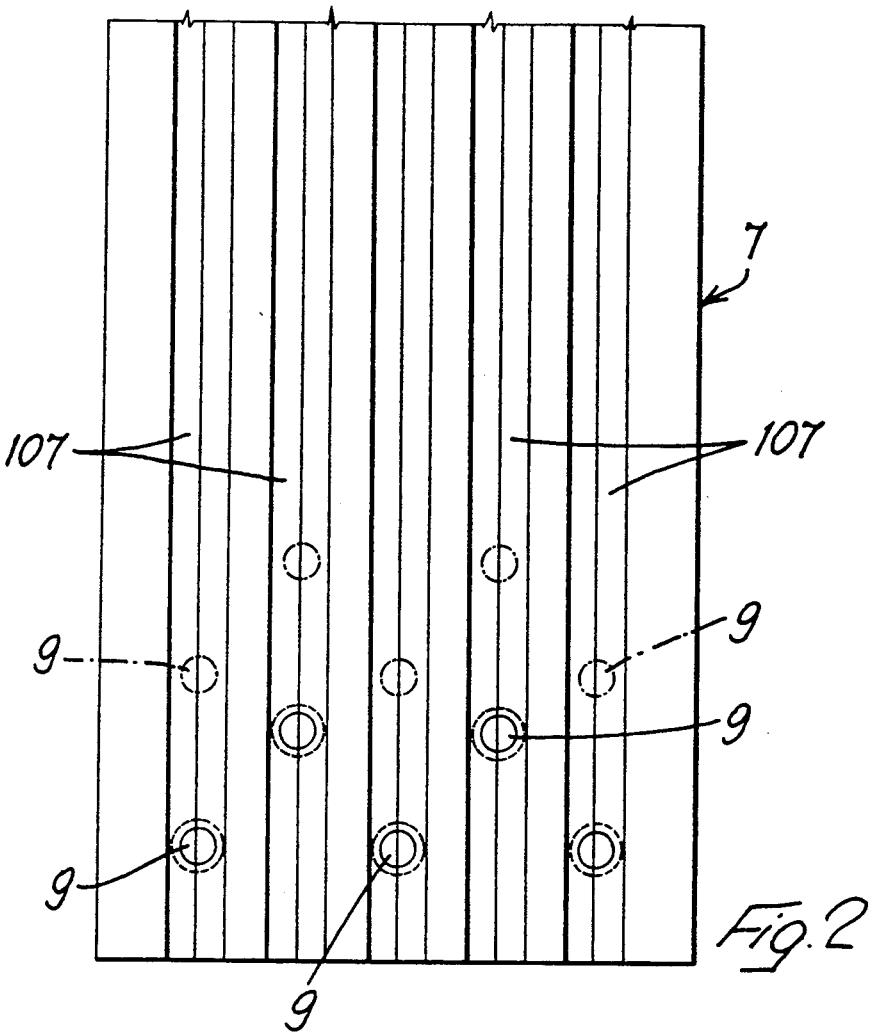
FIG. 2 is a top view of the grooved vibrating table on which the capsules to be sorted, which come from the feed hopper, advance in single file and in a plurality of rows.
Figure 5:
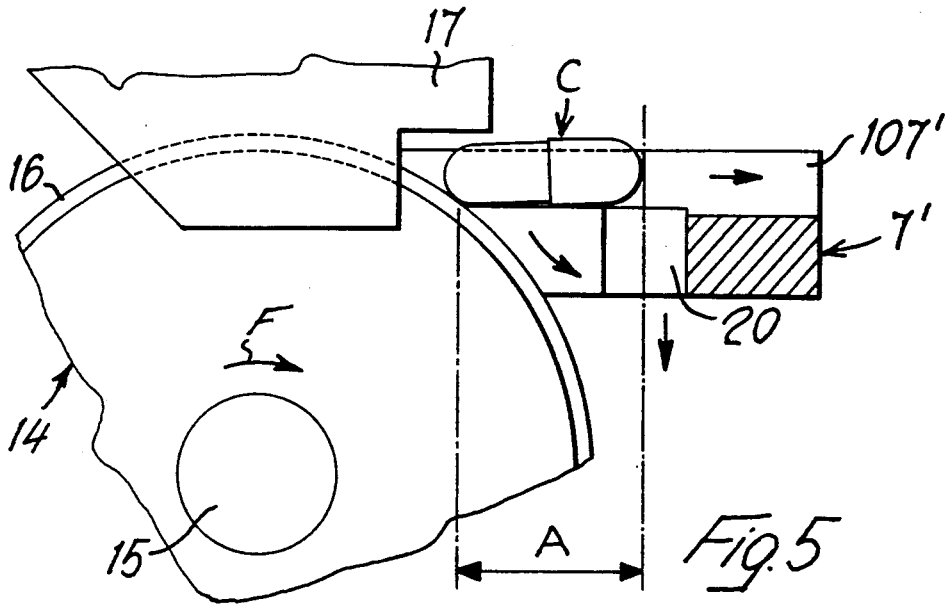
FIG. 5 shows on a larger scale the end part of the apparatus similarly to FIG. 1.

Through the action of the vibration transmitted by the unit 5 to the hopper 1 and to the table 7, the capsules penetrate under the wall 3, pass out of the holes 2 and arrange themselves horizontally in the channels 107, where said vibrations are initially of such a nature as to fluidify the stream of products falling out and then of such a nature as to space increasingly apart the capsules moving forwards in the channels 107 towards the right in FIG. 1. As also illustrated in FIG. 2, at the end part of the table 7 vertical through holes 9 are provided, appropriately staggered, in said channels, said holes having a diameter slightly greater than the outside diameter of the capsule covers and preferably being widened out at the bottom end, one or more such holes being provided for each channel 7. These holes form a trap of known type for the elimination of covers C1 separated from the shell C2 of the capsules C. The capsule covers C1 drop through the holes 9 into a fixed collection hopper 10 disposed therebeneath and provided with an evacuation duct 110.

Immediately downstream of the table 7 is provided a comb 11 composed of circular discs 111, which all have the same diameter and which are mounted as a pack on a shaft 12 extending at right angles to the channels 107 and supported rotatably by the ends of a fixed support structure 13, which does not vibrate. Downstream of each channel 107 a pair of discs 111 is lined up, with their inside faces disposed slightly greater a distance apart than the outside diameter of the shells C2 of the capsules and slightly less than the outside diameter of the shells C1 of said capsules. The shaft 12 is disposed substantially in the imaginary plane coplanar to the bottom face of the table 7, and the discs 111 have a diameter such that they project suitably above the top face of said table.

The shaft 12 together with the discs 111 is rotated at an appropriate speed at least equal to or slightly higher than that at which the capsules arrive, and in the direction indicated by the arrow F, in such a manner that the projecting part of said discs 111 rotates away from the table 7. The comb 11 forms a trap which allows everything to fall which has a diameter equal to or less than the outside diameter of the capsule shells. Consequently, shells C2 which have become separated from the previously discharged covers C1, and any capsules which are closed but crushed, will fall into the hopper 10. Correctly preclosed or closed capsules are inserted by their shells between the discs 111 and are held with the edge of their covers supported on the circumference of said discs, the rotation of which carries the capsules downstream from the combs formed by said discs. It can be seen that in this delicate phase, in which the capsules have their shells directed downwards and are supported by their covers, the capsules are not subjected to vibration and that consequently they remain correctly preclosed or closed.

Correctly preclosed or closed capsules, and also capsules provided with covers on both ends of the shell pass downstream of the comb 11.

Another comb 14 composed of rotating discs is provided immediately downstream of the comb 11, and is equipped with identical circular discs 114 keyed on a shaft 15 parallel to the shaft 12; like the latter, said shaft 15 rotates in the direction of the arrow F. The discs 114 are inserted between each pair of discs 111 as far as a short distance from the shaft 12 and are positioned at a lower level than the discs 111, for example in such a manner as to be substantially tangent to the imaginary plane containing the top face of the table 7. The discs 114 are in addition characterised in that they have a diameter appropriately greater than that of the discs 111, so as to rotate at a higher peripheral speed and to carry the capsules over a slightly parabolic path the most similar to a straight line. Finally, the discs 114 are characterised in that they have a periphery whose coefficient of friction is sufficiently high in cooperation with the capsules C. This condition is met by rubber rings 16 which cover the grooved periphery of the discs 114 to serve as tyres.

The capsules conveyed by the rotating comb 11 are taken over by the rotating comb 14, which conveys them longitudinally and directs all or almost all of them (high percentages above 90% have been achieved) with the cover facing forwards. While being conveyed by the comb 14, the capsules are guided laterally and channelled by fixed, parallel plates 17 disposed at the side of each disc 114 and supported by a shaft 18 connected to the fixed support structure 13, as can also be seen in the detail shown in FIG. 4.

On leaving the comb 14–17 (FIGS. 1 to 5), the capsules are received by channels 107' in a short table 7' of the same type as the table 7 and connected to the latter by means of supports 207 in such a manner as to vibrate. The supports 207 may be flexible and dampers may be provided on the table 7' to ensure that the latter will vibrate gently at a different rate from the vibration of the table 7 upstream. For this purpose it is not impossible for the table 7' to be structurally separate from the table 7 and to be operated by its own vibrator, entirely in a manner which can be conceived and put into practice by those versed in the art.

The table 7' has in the middle of each channel, immediately downstream of each disc 114 of the comb 14, a vertical through aperture 19 having parallel flanks and a width slightly greater than the outside diameter of the capsule shell, but smaller than the outside diameter of the capsule cover. At the end of this through aperture 19 a vertical through hole 20 is formed which has a diameter slightly greater than of the capsule covers. Provision is preferably made for the distance A between the centre of the top end of the hole 20 and the nearest point on the circumferenece of the disc 114 to be substantially equal to the length of a correctly preclosed or closed capsule. Means may be provided for registering said distance A in order to compensate for differences in length of the various deliveries of capsules.

The capsules leaving the comb 14–17 with the cover directed forwards pass along the channel 107' horizontally and when the cover reaches the hole 20 and they are released from the disc 114 they turn with the shell facing downwards and when the cover is centred over the hole 20 they fall through said hole and arrive in a hopper 21 disposed therebeneath and provided with a discharge duct 121 separate from the duct 110.

The few capsules which arrive on the table 7' with the cover directed backwards are immediately inserted by their shells into the aperture 19, and when they arrive with their covers over the hole 20 they fall through said hole into the hopper 21 disposed therebeneath. The path travelled over by the capsules in the vertical position and suspended on the cover is very short and the vibrations of the table 7' are greatly attenuated, so that the state of preclosure or closure of the capsules is not affected.

The capsules leaving the comb 14–17 with covers C1 at both ends of the shells C2 remain disposed horizontally over the aperture 19, pass over the hole 20, pass the terminal end of the table 7', and fall into a hopper 210 which is an extension of the hopper 10, so that they are mixed with the other defective capsule parts discharged through the duct 110.

Figure 3:
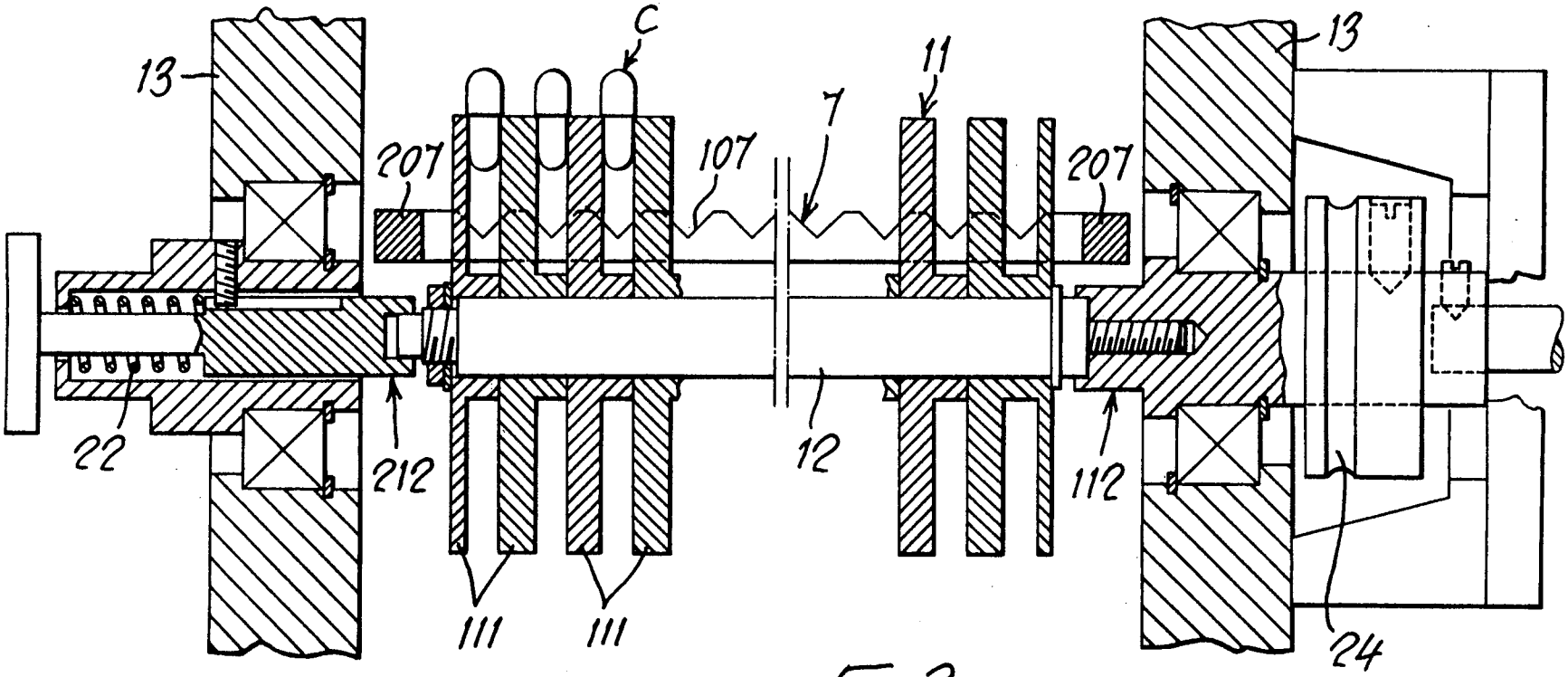
FIGS. 3 and 4 illustrate respective constructional details of the two rotating sorting combs in section on the lines III—III and IV—IV in FIG. 1.
Figure 4:
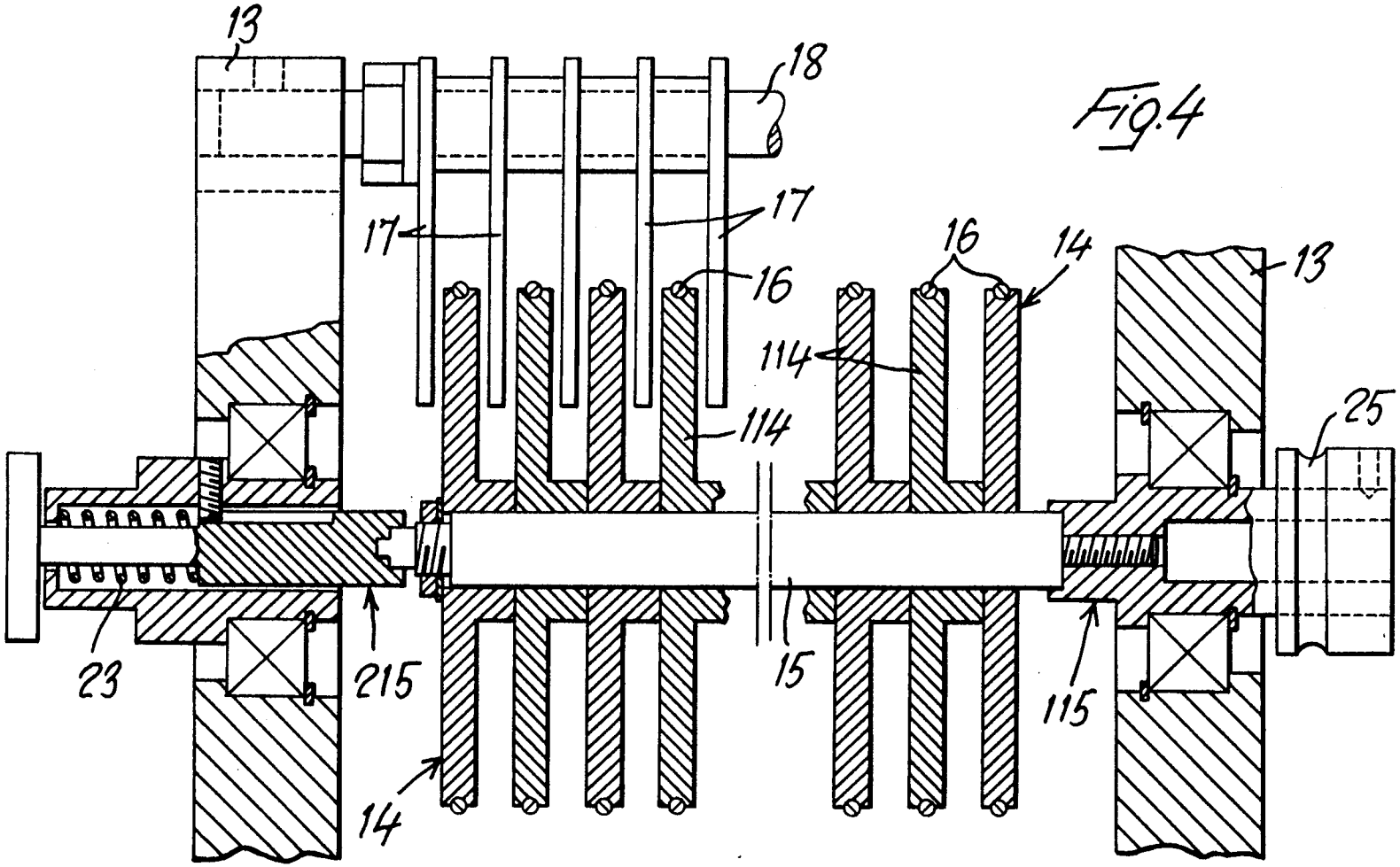

FIGS. 3 and 4 illustrate how the shafts 12 and 15 of the rotating combs 11 and 14 may be mounted between rotating supports 112–212 and 115–215 in such a manner that they can be rapidly replaced, the supports 212 and 215 being axially movable against the action of springs 22 and 23. The shafts 18 of the comb 17 are also connected to the support structure 13 in such a manner as to be rapidly removable, for the purpose of facilitating replacement of said combs when the dimensions of the capsules to be sorted are different.

Likewise in FIGS. 3 and 4, 24 and 25 indicate pulleys of suitable diameter, which are keyed on the shafts 12 and 15 for connection to the drive means effecting the rotation of said shafts.

We claim:

1. Apparatus for sorting hard gelatine capsules, having a shell and at least one capsule cover separate correctly preclosed or closed, undeformed capsules from capsules which are open or not correctly closed or are deformed, characterised in that it comprises:

means for feeding the capsules one behind the other and in any orientation into an initial part of longitudinal channels in a horizontal or substantially horizontal table on which said capsules move forwards horizontally in a lengthwise direction while becoming spaced further and further apart through action of vibrations transmitted to said table by appropriate means;

at a short distance from the end portion of each channel conveying the capsules one or more vertical through holes are provided, which have a diameter slightly greater than the outside diameter of the covers of the capsules, and which allow any covers detached from the capsule shells to fall into a collection and discharge hopper disposed therebeneath;

a first rotating comb disposed immediately downstream of the channelled table conveying the rows of capsules, said comb being composed of a plurality of circular, parallel discs keyed on a common shaft disposed at right angles to the capsule feed channels and positioned under said channels in such a manner that said discs project appropriately beyond them, said shaft being rotatably supported by a fixed structure and being rotated by appropriate means in such a manner that the discs are moved with their top part moving away from the capsule feed channels and at a peripheral speed equal to or expediently higher than the speed of arrival of said capsules, provision being made for the discs of the comb in question to be spaced equidistantly apart two by two and for the distance between each pair of discs to be slightly greater than the diameter of the capsule shells and smaller than the outside diameter of the capsule covers, each pair of discs being aligned by its centre with a feed channel, in such a manner that whatever the orientation of the capsules fed they will remain suspended by their covers between the circumferences of the pairs of discs, while by their shells they will on the other hand be inserted between the same discs in such a manner as to be conveyed by the latter with their shells directed downwards, while shells not provided with covers and everything having the same or a smaller diameter will pass freely between the same discs and fall into the hopper disposed therebeneath;

a second rotating comb formed by a plurality of circular, identical and parallel discs interposed and centered between the pairs of discs of the first rotating comb and keyed on a shaft parallel to the shaft of said first rotating comb, is, like the latter, caused to rotate in the same direction and in such a manner that the peripheral speed of the discs of the second comb is higher than that of the discs of the first comb, provision being made for the discs of said second rotating comb to have a circumference having a sufficiently high coefficient of friction with the capsules and to be so disposed and dimensioned that all of substantially all of said capsules reach said discuss with the cover directed forwards, and provision being made for said capsules to be held on said last-mentioned discs by fixed parallel guide plates; and downstream of the second rotating comb a short horizontal vibrating table is disposed which is provided with longitudinal channels having a V-shaped or similar profile and aligned longitudinally with the centre of each disc of said second comb, said channels being provided in their bottoms, starting from the end near the discs, with a longitudinal aperture whose width is slightly greater than the outside diameter of the shell and smaller than the outside diameter of the cover of the capsule and which ends in a vertical hole having a diameter appropriately larger than the outside diameter of said capsule cover, provision being made for the distance between the axis of said hole and the initial part of the small vibrating table to be so calculated as to ensure that the capsules leaving the discs of the second comb will have their shells directed downwards because of the provision of said aperture and will rapidly arrive over said hole and fall into a collecting and discharge hopper disposed therebeneath, while capsules which have a cover on both ends will pass beyond said hole and fall from the end of the small vibrating table in question, where they will be received in an extension of the hopper for rejects.

2. Apparatus according to claim 1, characterised in that the discs of the second rotating comb have their circumference covered by a rubber ring which imparts to said discs the contact friction necessary for conveying the capsules.

3. Apparatus according to claim 1, characterised in that the discs of the second rotating comb have a diameter greater than that of the discs of the first rotating comb, also for the purpose of ensuring that as far as possible the capsules are transferred in a horizontal arrangement or at least with very little probability of overturning on the last short vibrating table.

4. Apparatus according to claim 1, characterized in that the last short vibrating table is subjected to its own vibration or to vibration derived from that of the first vibrating table, and in any case in such a manner that the capsules are subjected to a slight vertical displacement and to a horizontal displacement which ensures rapid discharge of the capsules coming from the second rotating comb in order not to modify the state of closure of the capsules and in order to avoid obstruction.

5. Apparatus according to claim 1, characterized in that the capsules are placed at random in a vibrating feed hopper equipped with a double bottom whose top wall is at a distance from its bottom wall appropriately greater than the diameter of the capsule covers, said top wall being provided with one or more perimetrical apertures for the passage of the capsules to the bottom of said hopper, which has in a substantially central position vertical holes which are widened out at the top and through which one capsule at a time passes out, said holes being positioned in the initial part of the channels in the main vibrating table at a distance such as to prevent the capsules from rebounding in its fall, during which said capsule is guided by an appropriately directed guide wall which assists the capsules in assuming a horizontal position in said channels in the vibrating table.

6. Apparatus according to claim 1, characterised in that all the components whose dimensions have to be modified when the dimensions of the capsules to be sorted vary are equipped with registration means or are arranged for simple, rapid replacement.

7. Apparatus according to claim 1 wherein said longitudinal channels are of v-shaped profile.

8. Apparatus according to claim 1 wherein said through holes are widened out at the bottom part.

9. Apparatus according to claim 5 wherein said distance between the top and bottom walls of said double bottom of said vibrating feed hopper is about one and a half times the diameter of the capsule covers.

10. Apparatus according to claim 1 wherein all the components whose dimensions have to be modified when the dimensions of the capsules to be sorted vary are equipped with registration means and are arranged for simple, rapid replacement.

* * * * *